US010995766B2

(12) United States Patent
Usami

(10) Patent No.: US 10,995,766 B2
(45) Date of Patent: May 4, 2021

(54) CENTRIFUGAL BLOWER

(71) Applicant: DENSO CORPORATION, Kariya (JP)

(72) Inventor: Hiroyuki Usami, Kariya (JP)

(73) Assignee: DENSO CORPORATION, Kariya (JP)

( * ) Notice: Subject to any disclaimer, the term of this patent is extended or adjusted under 35 U.S.C. 154(b) by 64 days.

(21) Appl. No.: 16/559,468

(22) Filed: Sep. 3, 2019

(65) Prior Publication Data

US 2019/0390685 A1 Dec. 26, 2019

Related U.S. Application Data

(63) Continuation of application No. PCT/JP2018/003351, filed on Feb. 1, 2018.

(30) Foreign Application Priority Data

Mar. 13, 2017 (JP) ..... JP2017-047478

(51) Int. Cl.
*F04D 29/42* (2006.01)
*F04D 13/06* (2006.01)
*F04D 29/28* (2006.01)

(52) U.S. Cl.
CPC ..... *F04D 29/281* (2013.01)

(58) Field of Classification Search
CPC ..... F04D 29/281; F04D 29/30; F04D 19/002; F04D 29/162; F04D 29/703; F04D 29/526; F04D 29/242; F04D 29/167
See application file for complete search history.

(56) References Cited

U.S. PATENT DOCUMENTS 6,007,300 A * 12/1999 Saeki ..... F04D 29/30 416/178
2005/0103042 A1* 5/2005 Sanagi ..... F04D 29/281 62/419
2010/0014965 A1* 1/2010 Watanabe ..... F04D 29/4233 415/204
2012/0156025 A1* 6/2012 Fukuda ..... F04D 25/0613 415/206

(Continued)

FOREIGN PATENT DOCUMENTS

JP H08247090 A 9/1996
JP 2001115991 A 4/2001

(Continued)

*Primary Examiner* — Long T Tran
(74) *Attorney, Agent, or Firm* — Harness, Dickey & Pierce, P.L.C.

(57) ABSTRACT

A centrifugal blower includes an impeller and a casing having an air intake portion. The air intake portion has a bell mouth lower end portion that includes a downstream end, and a bell mouth inner surface portion that includes a radially inner surface. The shroud has a shroud upper end portion that includes an upstream end, and a shroud inner surface portion that includes a radially inner surface. The bell mouth lower end portion and the shroud upper end portion face each other in the axial direction across a gap. A difference between a diameter smallest in the bell mouth inner surface portion and a diameter smallest in the shroud inner surface portion is equal to or smaller than a thickness of the shroud. A vertical vortex generating mechanism configured to generate a vertical vortex is provided on the bell mouth inner surface portion.

7 Claims, 11 Drawing Sheets

(56) References Cited

U.S. PATENT DOCUMENTS

| | | | | |
|---|---|---|---|---|
| 2012/0195747 | A1* | 8/2012 | Fukuda | F04D 29/4226 415/206 |
| 2013/0092357 | A1* | 4/2013 | Sato | F04D 29/441 165/121 |
| 2014/0023501 | A1* | 1/2014 | Ikeda | F04D 29/30 416/95 |
| 2015/0167674 | A1* | 6/2015 | Kurihara | F04D 17/10 415/206 |
| 2017/0130723 | A1 | 5/2017 | Kosaka et al. | |
| 2017/0175764 | A1* | 6/2017 | Usami | F04D 29/162 |
| 2017/0234318 | A1* | 8/2017 | Oshikiri | H02K 5/1675 415/206 |

FOREIGN PATENT DOCUMENTS

| | | | |
|---|---|---|---|
| JP | 201614368 | A | 1/2016 |
| JP | 2016035230 | A | 3/2016 |
| JP | 201789480 | A | 5/2017 |
| JP | 2017110626 | A | 6/2017 |

* cited by examiner

CENTRIFUGAL BLOWER

CROSS REFERENCE TO RELATED APPLICATION

The present application is a continuation application of International Patent Application No. PCT/JP2018/003351 filed on Feb. 1, 2018, which designated the U.S. and claims the benefit of priority from Japanese Patent Application No. 2017-047478 filed on Mar. 13, 2017. The entire disclosures of all of the above applications are incorporated herein by reference.

TECHNICAL FIELD

The present disclosure relates to a centrifugal blower that takes in air from one side in an axial direction of a rotation shaft and blows the air outward in a radial direction.

BACKGROUND

In a conventional centrifugal blower, a noise caused by a separation of air flow from a negative pressure surface of blades due to an interference of a main flow and a leakage flow is suppressed by limiting a leakage of airflow through a gap between a shroud and a bell mouth of a centrifugal fan. A conventional centrifugal blower may have a configuration in which a labyrinth seal portion extending along a rotation direction is provided at a part of an air intake side end of the shroud in a negative pressure surface area facing the bell mouth.

SUMMARY

A centrifugal blower according to an aspect of the present disclosure includes an impeller and a casing. The impeller has blades arranged radially about an axis line of a rotation shaft, and an annular shroud that connects end parts of the blades in an axial direction. The impeller is configured to rotate about the axis line of the rotation shaft. The casing accommodates the impeller and includes an air intake portion positioned adjacent to the shroud. The air intake portion has a bell mouth shape to guide an air to an inside of the impeller.

The air intake portion has a bell mouth lower end portion that includes a downstream end of the air intake portion with respect to an airflow, and a bell mouth inner surface portion that includes a radially inner surface of the air intake portion. The shroud has a shroud upper end portion that includes an upstream end of the shroud with respect to the airflow, and a shroud inner surface portion that includes a radially inner surface of the shroud.

The bell mouth lower end portion and the shroud upper end portion face each other in the axial direction across a gap. A difference between a diameter smallest in the bell mouth inner surface portion and a diameter smallest in the shroud inner surface portion is equal to or smaller than a thickness of the shroud. A vertical vortex generating mechanism configured to generate a vertical vortex whose rotation center axis is along a main flow of the air is provided on the bell mouth inner surface portion.

EMBODIMENTS

Figure 1:
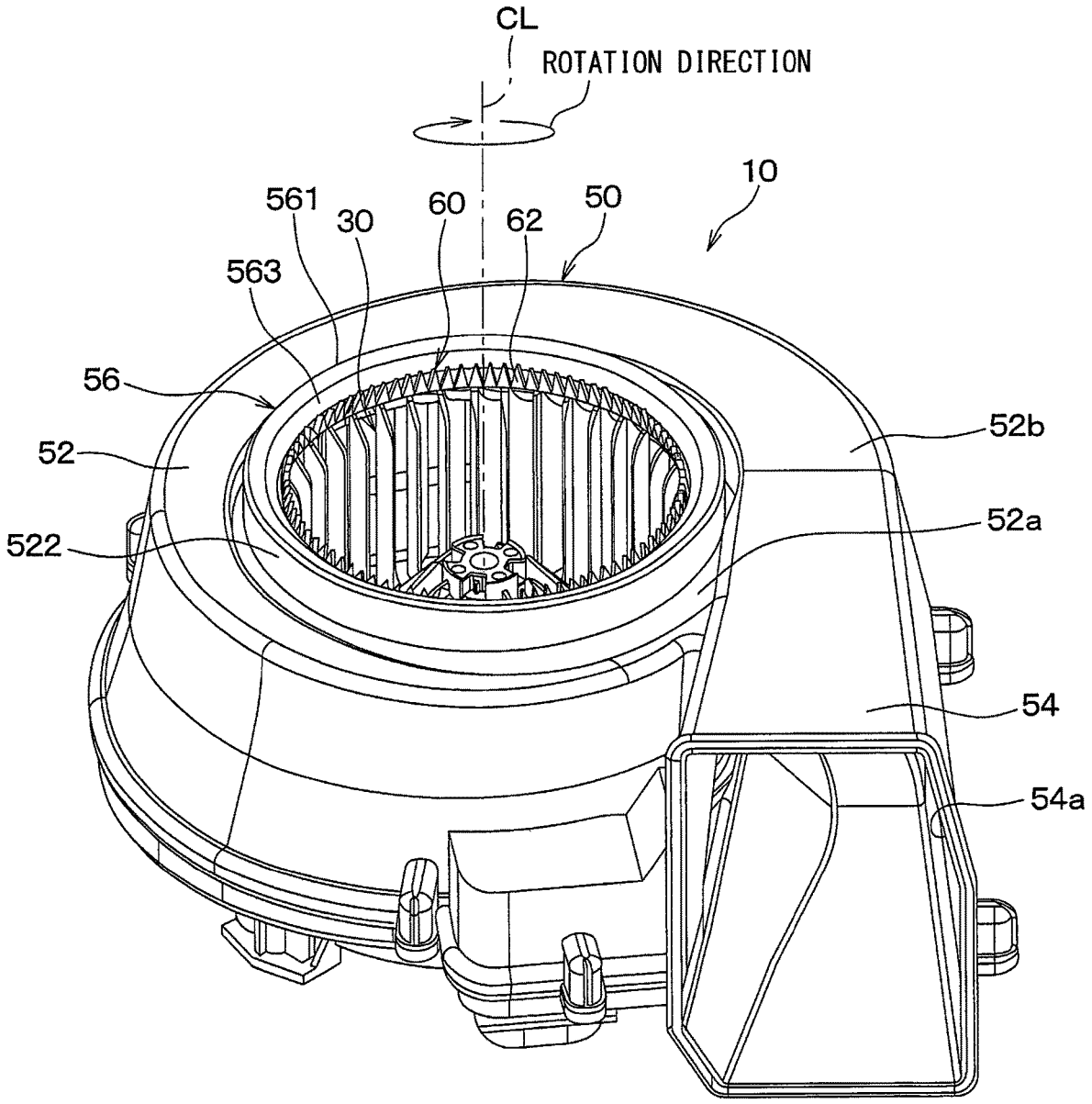
FIG. 1 is a schematic perspective view illustrating a centrifugal blower according to an embodiment.

An embodiment of the present disclosure is described with reference to FIG. 1 to FIG. 13. A centrifugal blower 10 shown in FIG. 1 is used in a blower unit that sends air to an interior unit of a vehicular air-conditioning device, for example.

Figure 2:
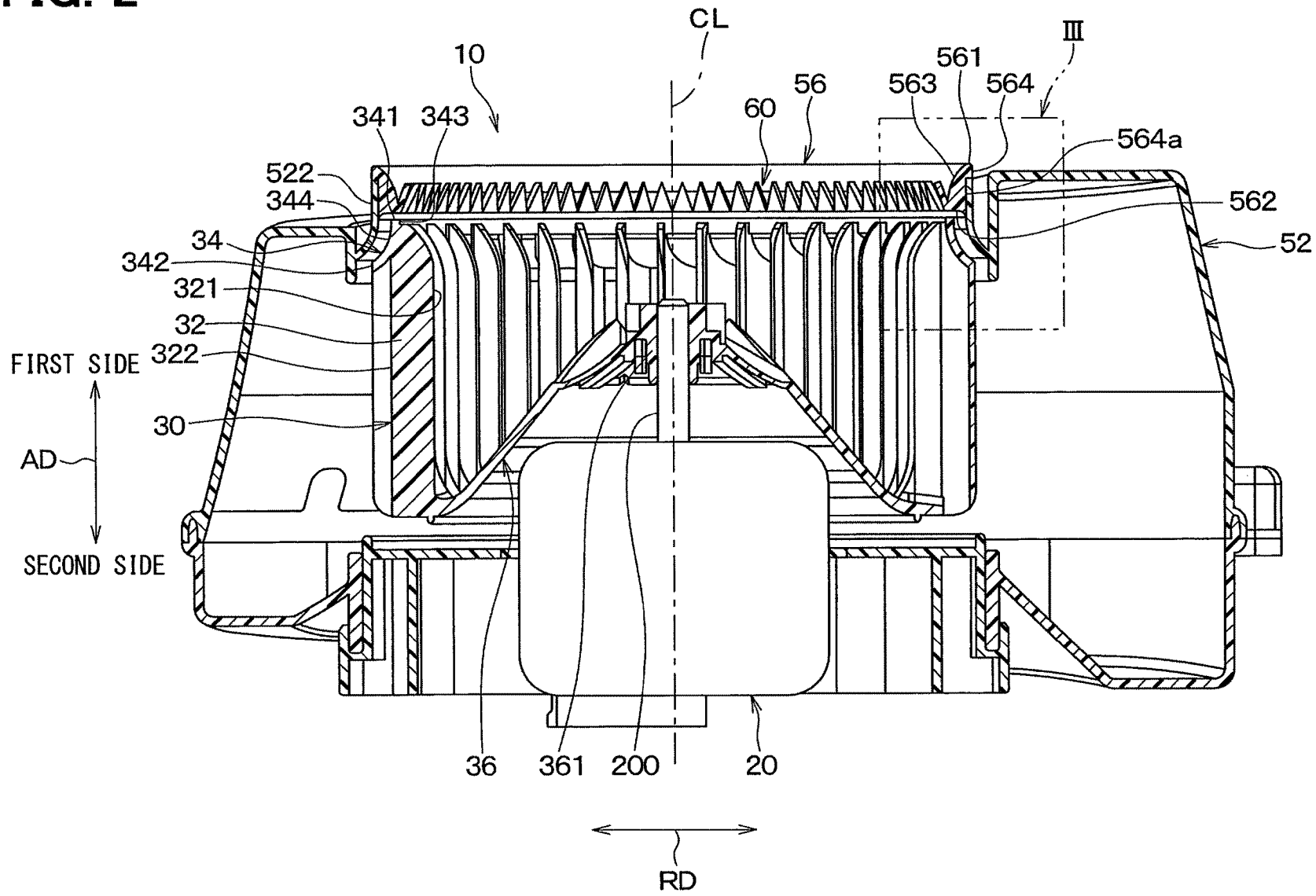
FIG. 2 is a schematic cross-sectional diagram of the centrifugal blower according to the embodiment taken along an axial direction.

As shown in FIG. 2, the centrifugal blower 10 includes an electric motor 20 having a rotation shaft 200, an impeller 30 that is rotated by the electric motor 20 to blow air, and a casing 50 accommodating the impeller 30. An arrow AD shown in FIG. 2 indicates an axial direction extending along an axis line CL of the rotation shaft 200. An arrow RD shown in FIG. 2 indicates a radial direction of the rotation shaft 200 perpendicular to the axial direction AD.

The impeller 30 rotates about the axis line CL of the rotation shaft 200. The impeller 30 includes multiple blades 32 radially arranged about the rotation shaft 200, an annular shroud 34 linking an end of each blades 32 on a first side in the axial direction AD with each other, and a main panel 36 linking an end of each blades 32 on a second side in the axial direction AD each other.

The blades 32, the shroud 34, and the main panel 36 constituting the impeller 30 of the present embodiment are integrated with each other to be a single component. Specifically, the blades 32, the shroud 34, and the main panel 36 are made of resin and integrally formed by injection molding.

The impeller 30 is a sirocco fan in which each blade 32 faces a leading side of a rotation direction. An air passage through which the air flows is defined between adjacent blades 32. Each blade 32 has a leading edge portion 321 defining an air inflow portion and a trailing edge portion 322 defining an air outflow portion.

The shroud 34 of the impeller 30 is constituted by an annular plate member whose center part is open. The shroud 34 is connected to a part of each blade 32 on the first side in the axial direction AD.

Figure 3:
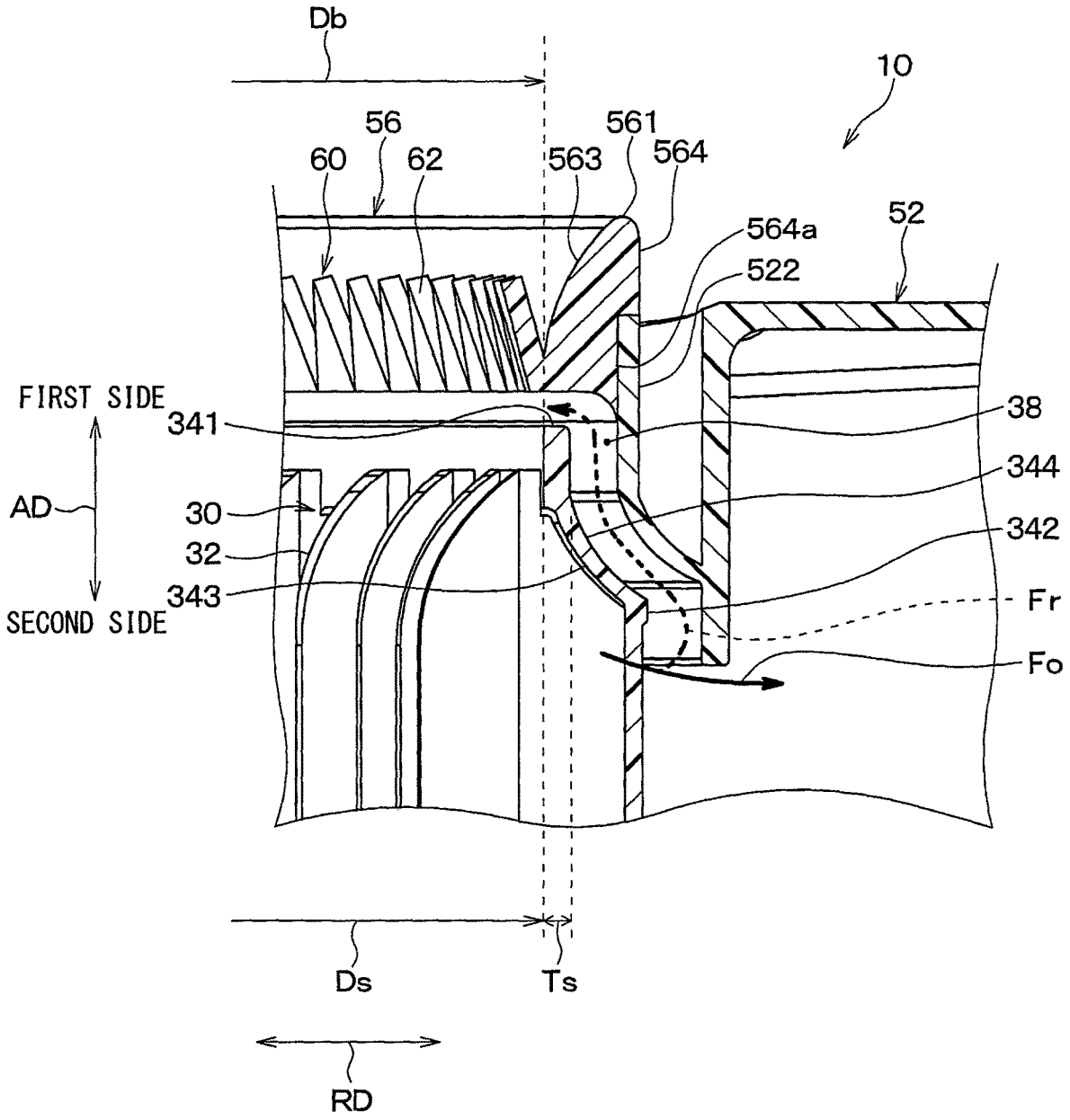
FIG. 3 is an enlarged view of a portion III of FIG. 2.

Specifically, as shown in FIG. 3, the shroud 34 has a shroud upper end portion 341 that is an end portion located on an air flow upstream side, and a shroud lower end portion 342 that is an end portion located on an air flow downstream side.

Further, the shroud 34 has a shroud inner surface portion 343 including an inner surface in the radial direction RD of the rotation shaft 200, and a shroud outer surface portion 344 including an outer surface in the radial direction RD of the rotation shaft 200.

The shroud inner surface portion 343 defines an introduction port that guides the air drawn through an air intake portion 56 of the casing 50 described later to an inside of the impeller 30. The shroud inner surface portion 343 has a shape convex inward of the impeller 30 such that the air flowing therein in the axial direction AD of the rotation shaft 200 is guided outward in the radial direction RD of the rotation shaft 200.

Specifically, a diameter of the shroud inner surface portion 343 gradually increases from the shroud upper end portion 341 toward the shroud lower end portion 342. In the shroud inner surface portion 343 of the present embodiment, the diameter at an end on the shroud upper end portion 341 is the smallest diameter Ds.

In the shroud 34, a thickness Ts at a part adjacent to the shroud upper end portion 341, that is, at a part at which the diameter is the smallest diameter Ds, is between 1 mm and 3 mm, for example, to reduce the weight of the impeller 30.

As shown in FIG. 2, the main panel 36 of the impeller 30 includes a cylindrical connection portion 361 at a center part of the main panel 36, and the main panel 36 is joined with the rotation shaft 200 through the connection portion 361. A part of each blade 32 on the second side in the axial direction AD of the rotation shaft 200 is connected to a part of the main panel facing the shroud 34 in the axial direction AD of the rotation shaft 200.

Specifically, the main panel 36 has a circular cone shape whose center part protrudes toward the first side in the axial direction AD to guide the air flowing in the axial direction AD of the rotation shaft 200 outward in the radial direction RD of the rotation shaft 200. The main panel 36 may have a flat shape extending along the radial direction RD of the rotation shaft 200.

The impeller 30 having the above-described configuration is accommodated in the casing 50. As shown in FIG. 1, the casing 50 has a scroll portion 52 in which the impeller 30 is accommodated, an air blowing portion 54 through which the scroll portion 52 is connected to the interior unit (not shown), and the air intake portion 56.

The scroll portion 52 is a member defining an air passage having a volute shape outside the impeller 30. The diameter of the scroll portion 52 gradually increases in the rotation direction of the impeller 30. The scroll portion 52 has a scroll start portion 52*a* at which the diameter is the smallest in the rotation direction of the impeller 30, and a scroll end portion 52*b* at which the diameter is the largest in the rotation direction of the impeller 30.

The air blowing portion 54 is connected to a part of the scroll portion 52 between the scroll start portion 52*a* and the scroll end portion 52*b*. The air blowing portion 54 extends along a tangent line of the scroll end portion 52*b* of the scroll portion 52 at. A discharge portion 54a through which the air is discharged opens on an air flow downstream side of the air blowing portion 54.

The scroll portion 52 includes a cylinder portion 522 having an annular shape at a part located on the first side in the axial direction AD of the rotation shaft 200 and adjacent to the shroud 34 of the impeller 30. The air intake portion 56 is connected to the cylinder portion 522. The cylinder portion 522 protrudes toward the first side in the axial direction AD of the rotation shaft 200. A part of the cylinder portion 522 faces the shroud outer surface portion 344 in the axial direction AD of the rotation shaft 200.

The air intake portion 56 is an annular member that guides the air to the inside of the impeller 30. The air intake portion 56 has a bell mouth shape. The air intake portion 56 is bonded to the cylinder portion 522 of the scroll portion 52 by a bonding technique such as an adhesive and welding. The air intake portion 56 may be joined to the cylinder portion 522 of the scroll portion 52 with a linkage member such as a screw.

As shown in FIG. 3, the air intake portion 56 has a bell mouth upper end portion 561 including an end located on the air flow upstream side, and a bell mouth lower end portion 562 including an end located on the air flow downstream side.

Further, the air intake portion 56 has a bell mouth inner surface portion 563 including an inner surface in the radial direction RD of the rotation shaft 200, and a bell mouth outer surface portion 564 including an outer surface in the radial direction RD of the rotation shaft 200.

The air intake portion 56 is provided in the scroll portion 52 such that the bell mouth lower end portion 562 faces the shroud upper end portion 341 in the axial direction AD of the rotation shaft 200 across a gap. The air intake portion 56 is provided in the scroll portion 52 so as not to overlap the shroud 34 in the radial direction RD of the rotation shaft 200.

The bell mouth inner surface portion 563 defines an intake port through which the air is taken into the inside of the impeller 30. The bell mouth inner surface portion 563 has a shape convex inward to guide the air toward the inside of the impeller 30.

Specifically, the diameter of the bell mouth inner surface portion 563 gradually decreases from the bell mouth upper end portion 561 toward the bell mouth lower end portion 562. In the present embodiment, a part of the bell mouth inner surface portion 563 adjacent to the bell mouth lower end portion 562 has the smallest diameter Db.

The bell mouth outer surface portion 564 extends along the axial direction AD of the rotation shaft 200. An engagement groove 564a configured to engage with the cylinder portion 522 of the scroll portion 52 is provided in the bell mouth outer surface portion 564.

If a step is formed between the bell mouth inner surface portion 563 and the shroud inner surface portion 343, the air flowing along the bell mouth inner surface portion 563 separates at the bell mouth lower end portion 562, and the air may not flow along the shroud inner surface portion 343.

In contrast, according to the bell mouth inner surface portion 563 and the shroud inner surface portion 343 of the present embodiment, substantially no step is formed between the bell mouth inner surface portion 563 and the shroud inner surface portion 343. That is, the inner surface portions 563, 343 of the present embodiment are designed such that the difference between the smallest diameter Db in the bell mouth inner surface portion 563 and the smallest diameter Ds in the shroud inner surface portion 343 is equal to or smaller than the thickness Ts of the shroud 34 (i.e., $|Ds-Db| \leq Ts$).

Specifically, the inner surface portions 563, 343 of the present embodiment are designed such that the smallest diameter Db in the bell mouth inner surface portion 563 is equal to or smaller than the smallest diameter Ds in the shroud inner surface portion 343 (i.e., $Db \leq Ds$). Further, the inner surface portions 563, 343 of the present embodiment are designed such that the smallest diameter Db in the bell mouth inner surface portion 563 is substantially equal to the smallest diameter Ds in the shroud inner surface portion 343 (i.e., $Db \approx Ds$).

In the centrifugal blower 10 of the present embodiment, a part of the bell mouth inner surface portion 563 adjacent to the bell mouth lower end portion 562 and a part of the shroud inner surface portion 343 adjacent to the shroud upper end portion 341 extend in parallel with the axial direction AD of the rotation shaft 200.

In the impeller 30, the air intake side and the air discharge side communicate with each other through a clearance passage 38 defined between the cylinder portion 522 of the scroll portion 52 and the shroud outer surface portion 344, and between the bell mouth lower end portion 562 and the shroud outer surface portion 344. Accordingly, a part of the air discharged from the impeller 30 and indicated by an arrow Fo in FIG. 3 flows back to the air intake side of the impeller 30 through the clearance passage 38. The back flow may cause the air flowing along the bell mouth inner surface portion 563 to separate from the shroud inner surface portion 343. That is, the back flow may limit the air flowing along the bell mouth inner surface portion 563 from flowing along the shroud inner surface portion 343.

In the air intake portion 56 of the present embodiment, a vertical vortex generating mechanism 60 is provided on the bell mouth inner surface portion 563. The vertical vortex generating mechanism 60 is configured to generate a vertical vortex whose rotation center axis is along the main flow of the air flowing into the air intake portion 56.

Figure 4:
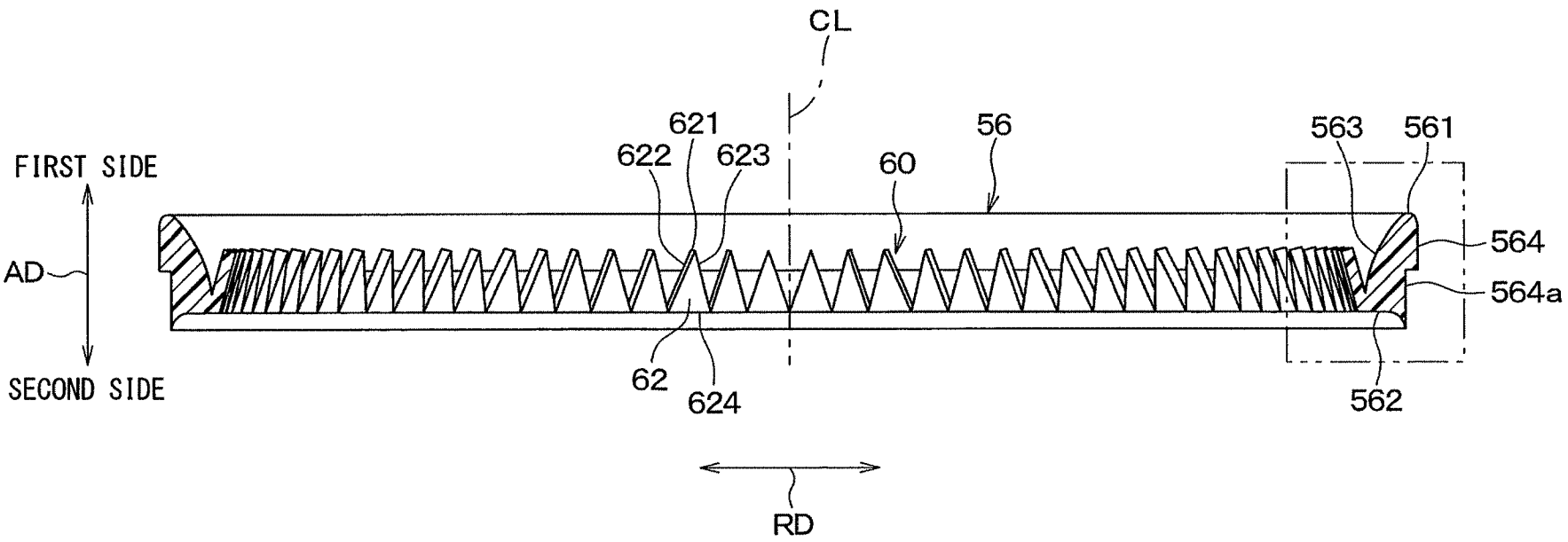
FIG. 4 is a schematic cross-sectional diagram of an air intake portion of the centrifugal blower according to the embodiment.

As shown in FIG. 4, the vertical vortex generating mechanism 60 includes multiple tooth portions 62 having a triangle shape whose width in a circumferential direction of the rotation shaft 200 decreases toward its tip. The tooth portions 62 constituting the vertical vortex generating mechanism 60 are provided entirely in the circumferential direction.

A tip portion 621 of each tooth portion 62 constituting the vertical vortex generating mechanism 60 at which two sides 622, 623 intersect each other is located upstream of a base portion 624 in contact with the bell mouth inner surface portion 563. Specifically, each tooth portion 51 has a shape sharpened toward the tip portion 621. The tooth portion 62 protrudes toward the air flow upstream side. The shape of the tip portion 621 of the tooth portion 62 is not limited to the sharp shape in which two sides 622, 623 are straight and intersects each other, and the tip portion 621 may be chamfered or rounded off.

The tooth portion 62 is provided on the bell mouth inner surface portion 563 in a state where the tooth portion 62 is tilted such that the tip portion 621 is positioned at an inner position in the radial direction of the rotation shaft 200 compared to the base portion 624. Specifically, a distance between the tooth portion 62 and a tangent line TL at the part of the bell mouth inner surface portion 563 having the smallest diameter Db increases toward the tip portion 621. The tangent line TL extends in a direction in which the part of the bell mouth inner surface portion 563 having the smallest diameter Db extends.

The tooth portion 62 is provided on the bell mouth inner surface portion 563 in a state where the tooth portion 62 is angled such that a skew angle θv between the direction in which the tooth portion 62 extends from the base portion 624 to the tip portion 621 and the tangent line TL of the bell mouth inner surface portion 563 is an acute angle. Specifically, the tooth portion 62 of the present embodiment is provided on the bell mouth inner surface portion 563 and angled such that the skew angle θv is about 30 degrees.

The tooth portion 62 of the present embodiment has an isosceles triangle shape in which lengths of the two sides 622, 623 intersecting at the tip portion 621 are equal to each other. A pair of vertical vortexes generated when the airflow passes the two sides 622 and 623 becomes likely to unite with each other by providing the tooth portion 62 in the isosceles triangle shape, and thus the vertical vortex may become stronger.

Specifically, in the tooth portion 62 of the present embodiment, a width Wv of the base portion 624 at which a length between the two sides 622, 623 is the largest is smaller than a height from the base portion 624 to the tip portion 621. The width Wv and the height Hv are a width and a height on a negative pressure side 62*b* of the tooth portion 62.

When a ratio of the width Wv to the height Hv is defined as an aspect ratio AR, the aspect ratio AR of the tooth portion 62 of the present embodiment is 2.0. That is, in the tooth portion 62 of the present embodiment, the height Hv is approximately twice the width Wv.

Figure 5:
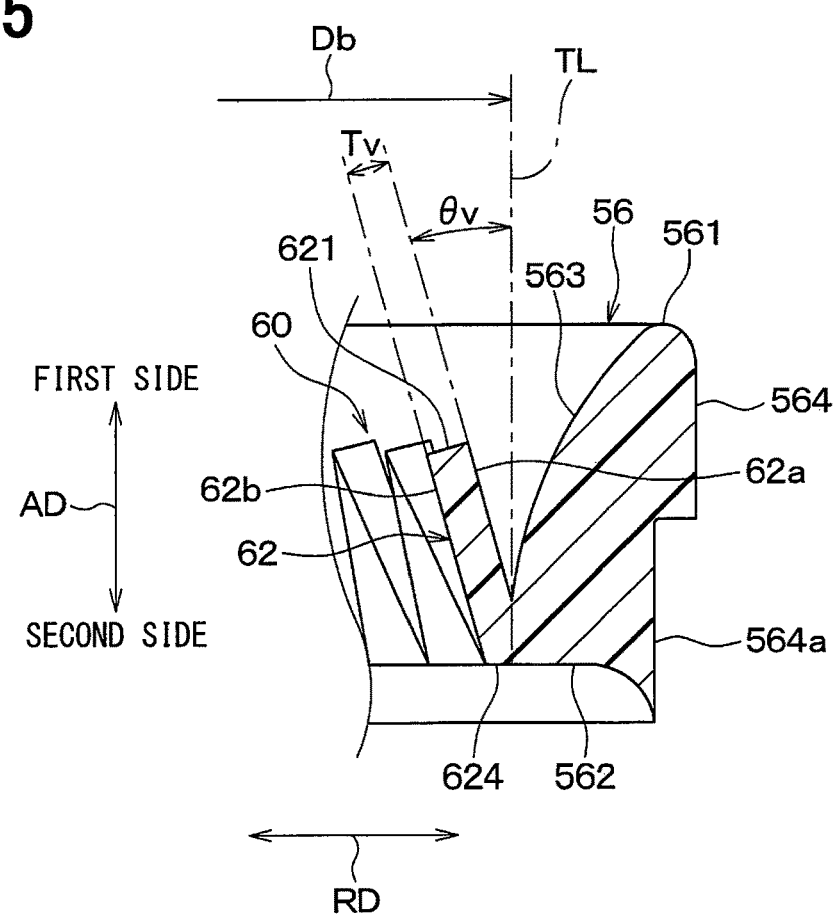
FIG. 5 is an enlarged view of a portion V of FIG. 4.
Figure 6:
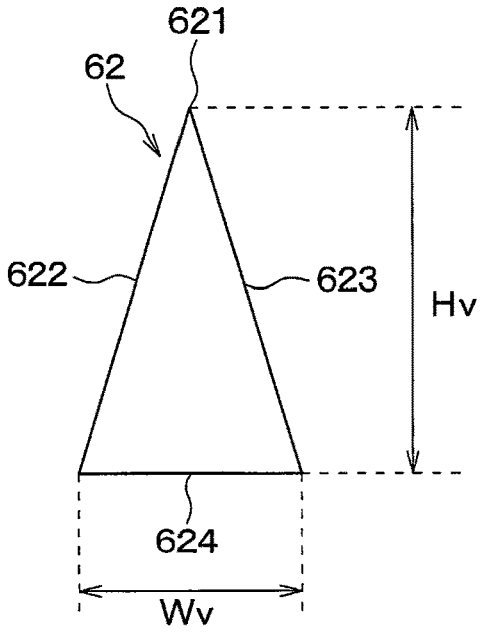
FIG. 6 is a front view of a tooth portion of a vertical vortex generating mechanism according to the embodiment.

When a thickness Tv of the tooth portion 62 shown in FIG. 5 is large, the lengths of the two sides 622, 623 on a positive pressure side 62*a* of the tooth portion 62 may be shorter than those on the negative pressure side 62*b*. When the lengths of the two sides 622, 623 on the positive pressure side 62*a* of the tooth portion 62 are small, the generation of the vertical vortex at the two sides 622, 623 of the tooth portion 62 may be deteriorated.

In view of this point, in the present embodiment, the thickness Tv of the tooth portion 62 is equal to or smaller than a thickness Ts of the shroud 34 (i.e., $Tv \leq Ts$). The positive pressure side 62*a* of the tooth portion 62 is an opposing surface facing the bell mouth inner surface portion 563. The negative pressure side 62*b* of the tooth portion 62 is an opposite side of the positive pressure side 62*a*.

The air intake portion 56 and the vertical vortex generating mechanism 60 of the present embodiment are provided as a single component. Specifically, the air intake portion 56 and the vertical vortex generating mechanism 60 are made of resin and formed by an injection molding to be a single component.

The tooth portion 62 of the present embodiment is provided on a part of the bell mouth inner surface portion 563 at which the diameter is the smallest diameter Db such that the tip portion 621 does not overlap the bell mouth inner surface portion 563 in the axial direction AD of the rotation shaft 200.

Figure 7:
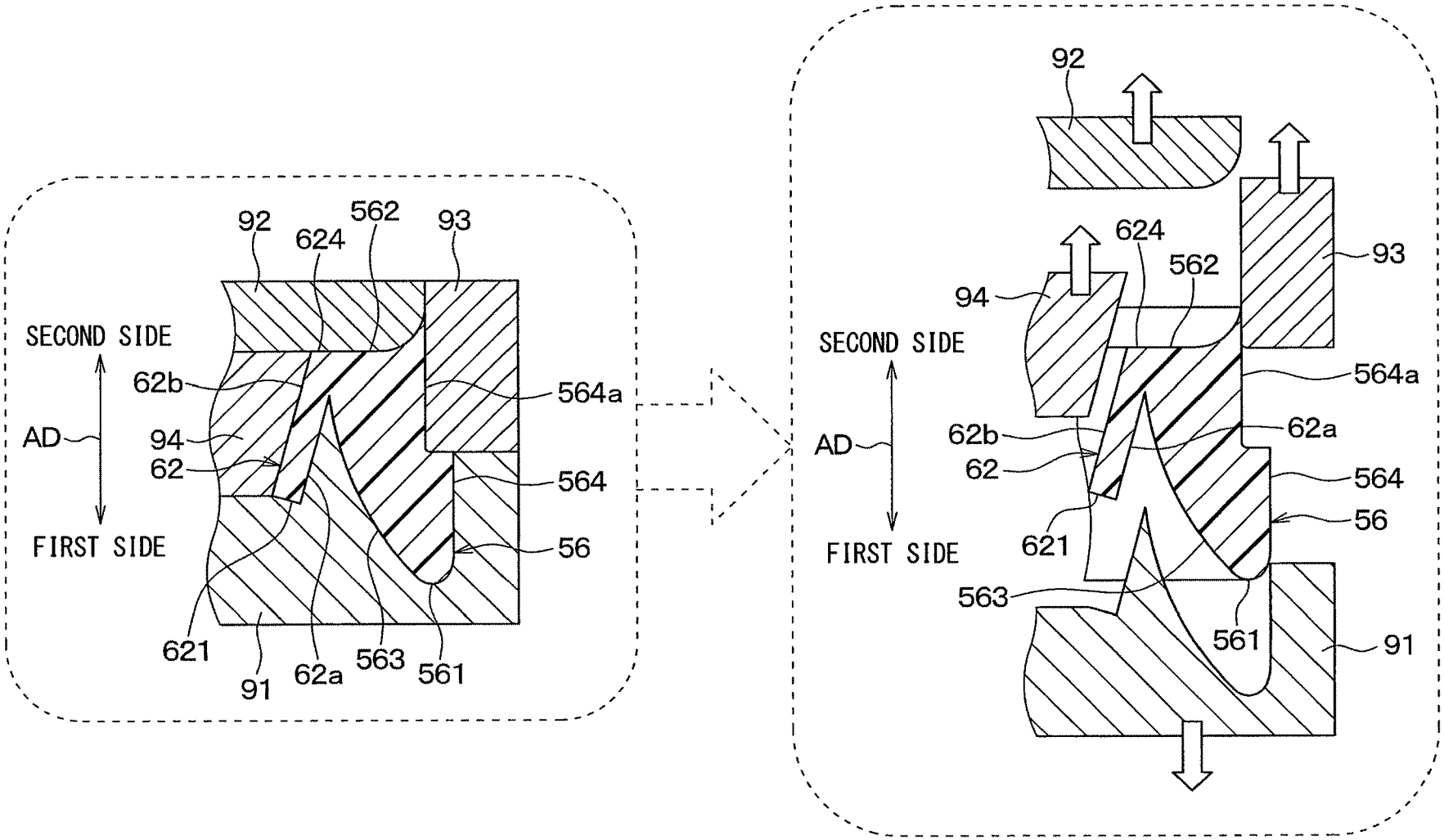
FIG. 7 is a diagram for explaining a method of manufacturing the air intake portion and the vertical vortex generating mechanism according to the embodiment.

The air intake portion 56 and the vertical vortex generating mechanism 60 can be formed as a single component by injection molding using first to fourth molding dies 91 to 94 as shown in FIG. 7, for example. The first molding die 91 is positioned on a first side in the axial direction AD of the rotation shaft 200 and has a shape corresponding to a part of the air intake portion 56 and the vertical vortex generating mechanism 60 exposed on the first side in the axial direction AD of the rotation shaft 200. The second molding die 92 is positioned on the second side in the axial direction AD of the rotation shaft 200 and has a shape corresponding to the bell mouth lower end portion 562 of the air intake portion 56. The third molding die 93 is positioned on the second side in the axial direction AD of the rotation shaft 200 and has a shape corresponding to the bell mouth outer surface portion 564 of the air intake portion 56. The fourth molding die 94 is positioned between the first molding die 91 and the second molding die 92 and has a shape corresponding to a part of the vertical vortex generating mechanism 60 exposed to the second side in the axial direction AD of the rotation shaft 200.

Particularly, in the air intake portion 56 and the vertical vortex generating mechanism 60 of the present embodiment, the bell mouth inner surface portion 563 does not overlap the tip portion 621 of the tooth portion 62 in the axial direction AD of the rotation shaft 200. Therefore, as shown on the right side of FIG. 7, the vertical vortex generating mechanism 60 and the air intake portion 56 can be formed as a single component by a molding process in which a die cutting direction is along the axial direction AD of the rotation shaft 200 without an undercut processing. Accordingly, an increase in cost for manufacturing the centrifugal blower 10 due to the addition of the vertical vortex generating mechanism 60 can be suppressed.

Next, the operation of the centrifugal blower 10 of the present embodiment will be described. In the centrifugal blower 10, the fan 30 rotates as the rotation shaft 200 of the electric motor 20 rotates. Accordingly, the air drawn into the impeller 30 through the air intake portion 56 is blown outward in the radial direction RD of the rotation shaft 200 by the centrifugal force.

Figure 8:
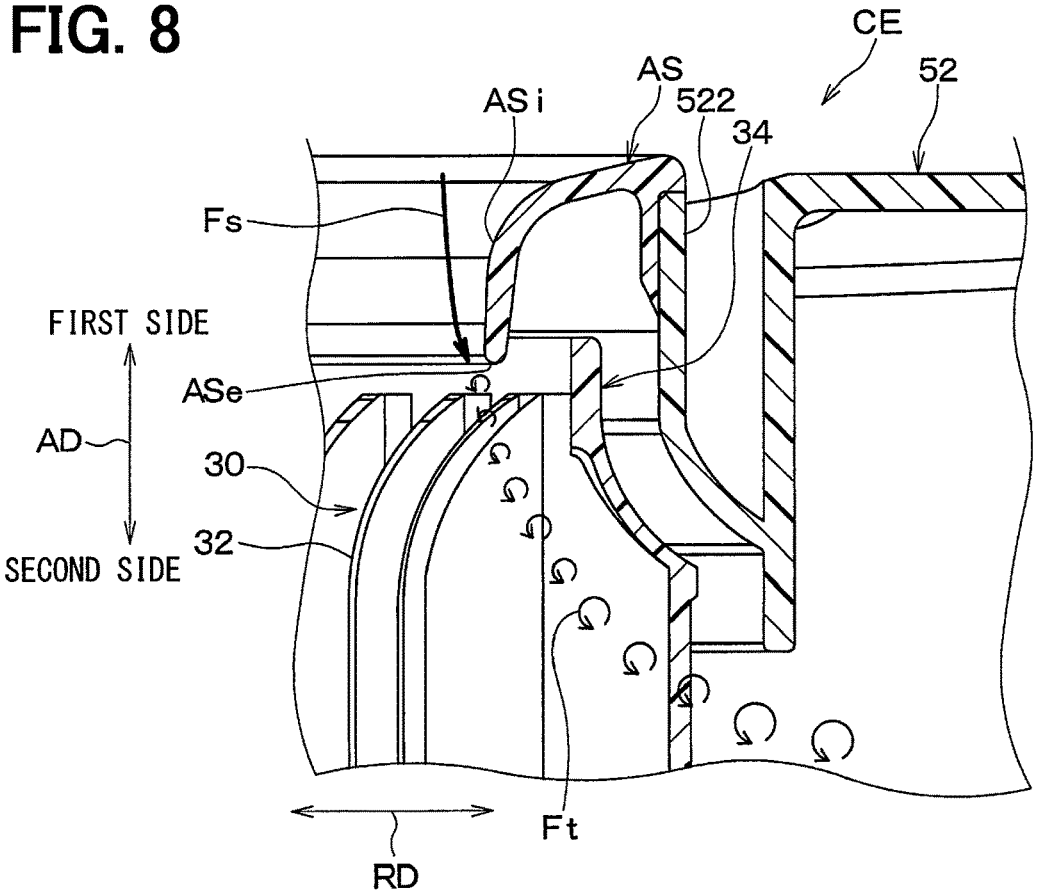
FIG. 8 is a cross-sectional diagram showing an airflow around an air intake portion of a centrifugal blower according to a comparative example of the embodiment.
Figure 9:
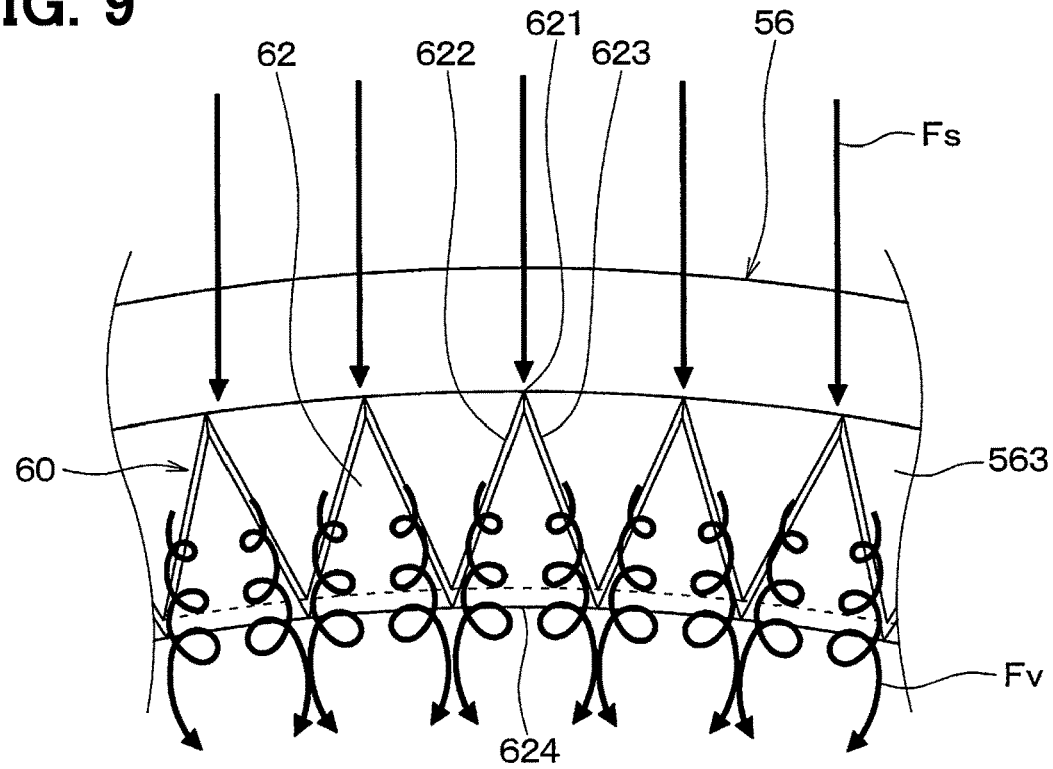
FIG. 9 is a diagram for explaining a vertical vortex generated by the vertical vortex generating mechanism of the centrifugal blower according to the embodiment.

FIG. 8 is a diagram illustrating an airflow around a shroud 34 of a centrifugal blower CE according to a comparative example of the present embodiment. The centrifugal blower CE of the comparative example is different from the centrifugal blower 10 of the present embodiment in that the shroud 34 is located outside an air intake portion AS and the the vertical vortex generating mechanism 60 is not provided on the air intake portion AS. For convenience of explanation, in FIG. 8, the same reference numerals are assigned to the same configurations as the centrifugal blower 10 of the present embodiment in the centrifugal blower CE of the comparative example.

In the centrifugal blower CE of the comparative example, as indicated by an arrow Fs of FIG. 8, air flowing along an inner surface ASi of the air intake portion AS is drawn by the rotation of the impeller 30. Since a large step is formed between the air intake portion AS and the shroud 34 in the centrifugal blower CE of the comparative example, the airflow along the inner surface ASi of the air intake portion AS separates at a lower end portion ASe of the air intake portion AS.

Accordingly, as indicated by an arrow Ft of FIG. 8, a turbulence accompanied by a horizontal vortex is generated in the air flowing into the vicinity of the shroud 34 of the impeller 30 from the inner surface ASi of the air intake portion AS. The turbulence grows as the airflow moves to the downstream side in the impeller 30. Consequently, a noise may increase, and a blowing effectiveness may decrease in the centrifugal blower CE of the comparative example. The horizontal vortex is a vortex whose center axis of rotation intersects the flow direction of the main flow.

In contrast, in the centrifugal blower 10 of the present embodiment, a difference between the smallest diameter Db at the bell mouth inner surface portion 563 of the air intake portion 56 and the smallest diameter Ds of the shroud inner surface portion 343 is equal to or smaller than the thickness Ts of the shroud 34.

Therefore, in the centrifugal blower 10 of the present embodiment, the air flowing along the bell mouth inner surface portion 563 of the air intake portion 56 is likely to flow along the shroud inner surface portion 343 after separating from the bell mouth lower end portion 562. That is, in the centrifugal blower 10 of the present embodiment, the air flowing around the shroud inner surface portion 343 is likely to flow along the shroud inner surface portion 343.

In the centrifugal blower 10, a part of the air discharged from the impeller 30 and indicated by an arrow Fo in FIG. 3 may flow back to the air intake side of the impeller 30 through the clearance passage 38. The back flow may cause the air flowing along the bell mouth inner surface portion 563 to separate from the shroud inner surface portion 343.

In the centrifugal blower 10 of the present embodiment, the vertical vortex generating mechanism 60 is provided on the bell mouth inner surface portion 563. In the centrifugal blower 10 of the present embodiment, the vertical vortex is generated at the vertical vortex generating mechanism 60 when the airflow along the bell mouth inner surface portion 563 flows through the two sides 622, 623 of the tooth portion 62, as indicated by arrows Fv shown in FIGS. 9, 10. The kinetic energy of the airflow away from the bell mouth inner surface portion 563 is added to the airflow around the bell mouth inner surface portion 563 by the vertical vortex.

Figure 10:
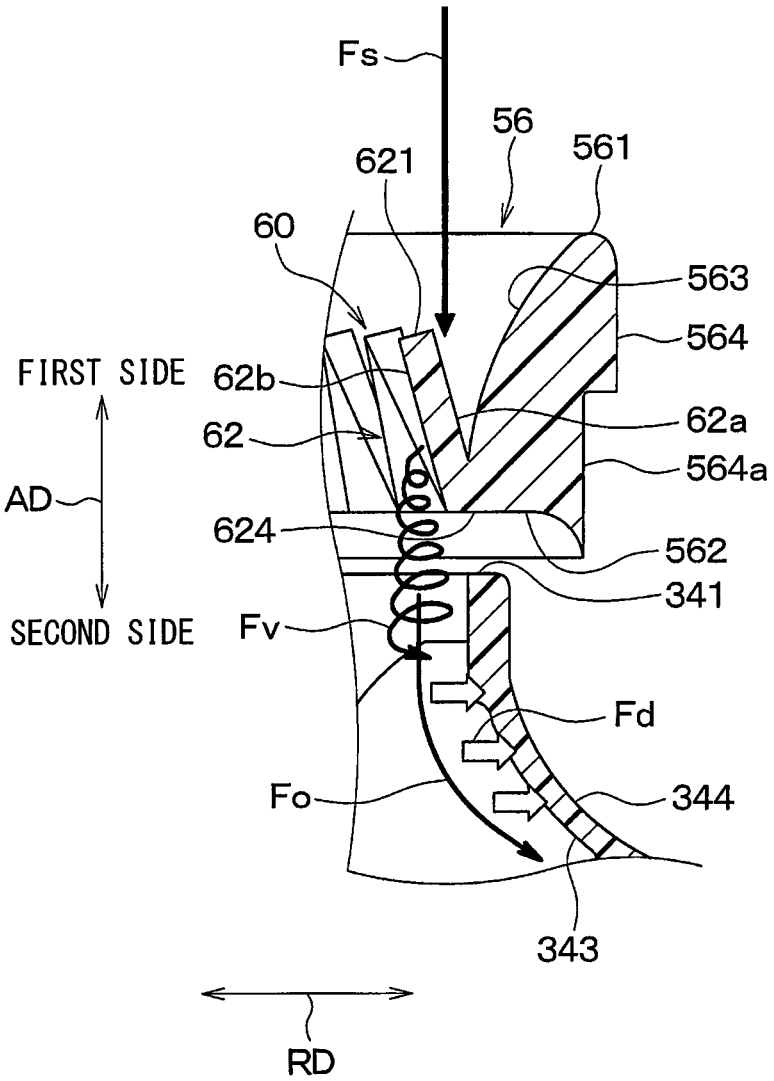
FIG. 10 is a diagram for explaining a vertical vortex generated by the vertical vortex generating mechanism of the centrifugal blower according to the embodiment.

Accordingly, the air flowing from the bell mouth inner surface portion 563 to the shroud inner surface portion 343 is pushed to the shroud inner surface portion 343 as indicated by an arrow Fd shown in FIG. 10. The arrow Fd of FIG. 10 indicates a direction of a down-flow exerting a pushing force pushing the air to the shroud inner surface portion 343.

Figure 11:
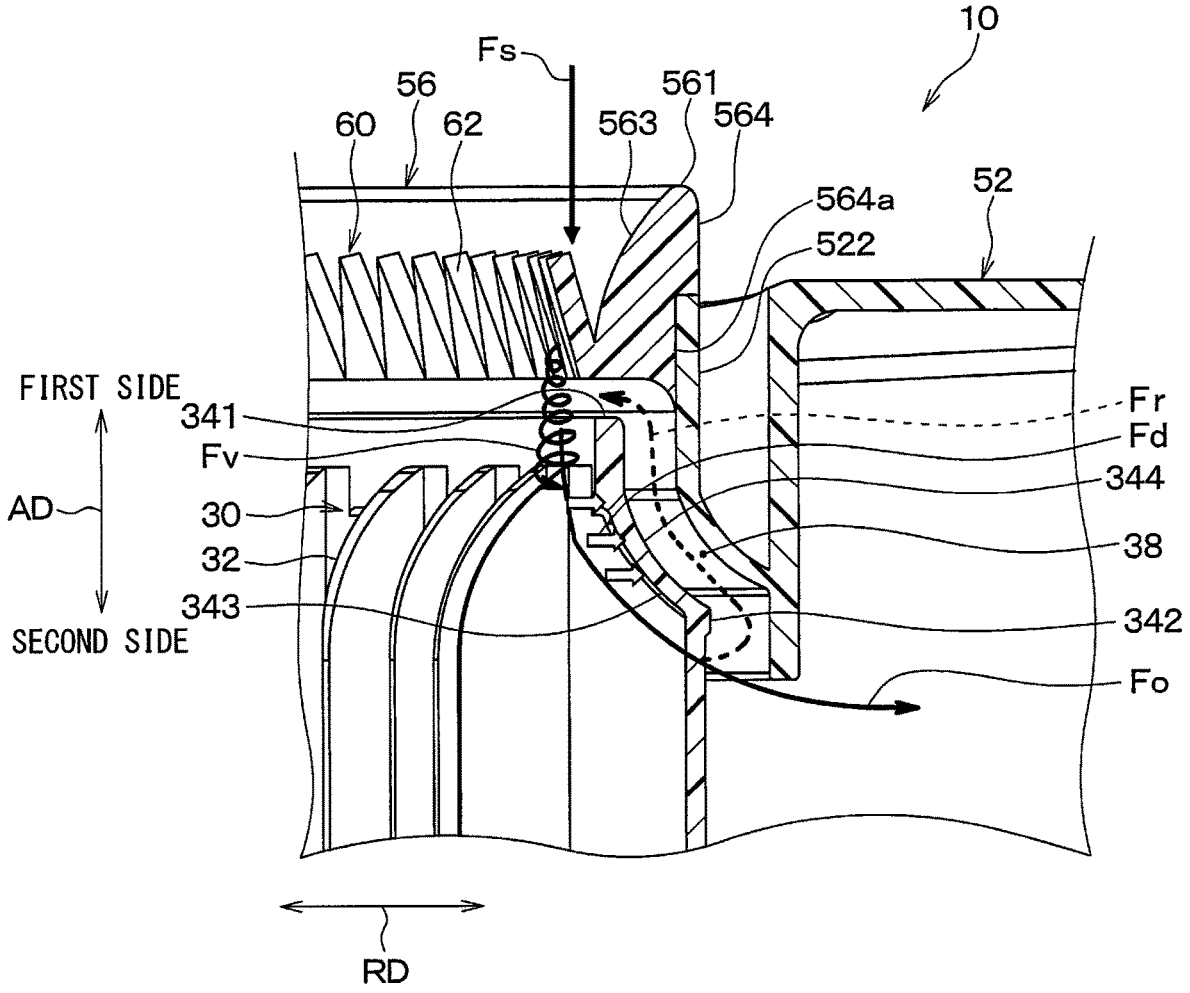
FIG. 11 is a cross-sectional diagram showing an airflow around the air intake portion of a centrifugal blower according to the embodiment.

In the centrifugal blower 10 of the present embodiment, when the air flowing along the bell mouth inner surface portion 563 indicated by an arrow Fs of FIG. 11 flows toward the shroud inner surface portion 343, the air is pushed to the shroud inner surface portion 343 by the vertical vortex indicated by an arrow Fv of FIG. 11. Accordingly, even when a back flow indicated by an arrow Fr of FIG. 11 flows out through the clearance passage 38, the air flowing into the vicinity of the shroud inner surface portion 343 from the bell mouth inner surface portion 563 is likely to flow along the shroud 34 without separating from the shroud 34.

In the centrifugal blower 10 of the present embodiment, since substantially no step is formed between the bell mouth inner surface portion 563 and the shroud inner surface portion 343, the airflow along the bell mouth inner surface portion 563 is likely to flow along the shroud inner surface portion 343.

In addition, the vertical vortex generating mechanism 60 configured to generate a vertical vortex is provided on the bell mouth inner surface portion 563. Accordingly, even when a back flow flows out through the clearance passage 38, the air flowing toward the vicinity of the shroud inner surface portion 343 from the bell mouth inner surface portion 563 is likely to flow along the shroud 34 without separating from the shroud 34.

According to the centrifugal blower 10 of the present embodiment, since the airflow along the air intake portion 56 is likely to smoothly flow toward the shroud 34, the separation of the air around the shroud 34 of the blade 32 can be sufficiently suppressed. As a result, the noise caused by the turbulence of the airflow around the shroud 34 of the impeller 30 of the centrifugal blower 10 is suppressed, and accordingly the efficiency of the blowing can be improved.

Specifically, in the centrifugal blower 10 of the present embodiment, the vertical vortex generating mechanism 60 has the tooth portions 62 having a triangle shape. Accordingly, the vertical vortex can be generated at the two sides 622, 623 of the tooth portion 62 when the air flowing along the bell mouth inner surface portion 563 passes the tooth portion 62. Thereby, the kinetic energy of the airflow away from the bell mouth inner surface portion 563 is added to the airflow close to the bell mouth inner surface portion 563, and the air flowing from the bell mouth inner surface portion 563 toward the shroud inner surface portion 343 is pushed to the shroud inner surface portion 343.

Specifically, the centrifugal blower 10 of the present embodiment is designed such that the smallest diameter Db in the bell mouth inner surface portion 563 is equal to or smaller than the smallest diameter Ds in the shroud inner surface portion 343 (i.e., Db≤Ds). Accordingly, the turbulence caused by a collision of the air flowing along the bell mouth inner surface portion 563 with the shroud 34 can be suppressed.

Figure 12:
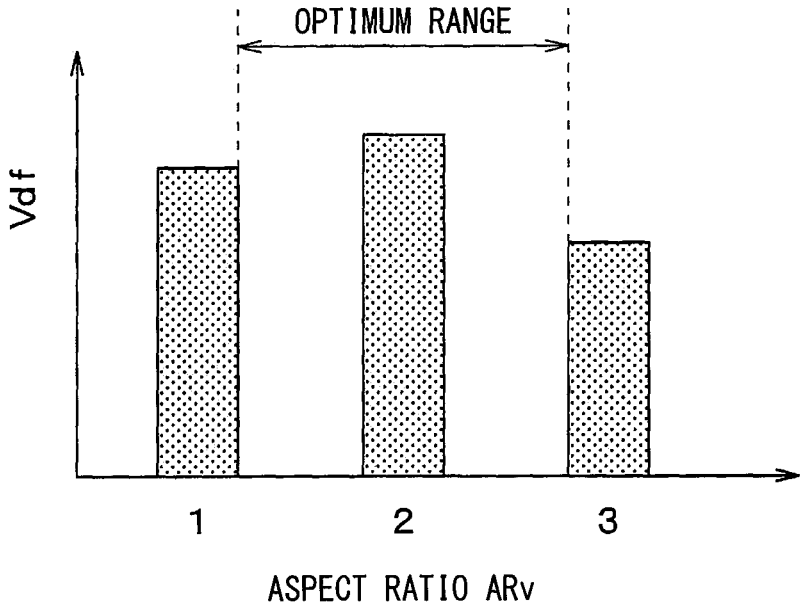
FIG. 12 is a characteristic diagram showing a change in a down-flow velocity when an aspect ratio of a tooth portion of the vertical vortex generating mechanism is changed.

FIG. 12 is a characteristic diagram showing a change in the down-flow velocity Vdf when the aspect ratio ARv of the tooth portion 62 of the vertical vortex generating mechanism 60 is changed. FIG. 12 shows a result of 3D modeling of each tooth portion 62 and quantification of the down-flow velocity Vdf on the downstream side of each tooth portion 62 by CFD analysis. The down-flow velocity Vdf is a velocity of the down-flow Fd.

As shown in FIG. 12, the down-flow velocity Vdf becomes significantly larger near the aspect ratio ARv of "2.0" than when the aspect ratio ARv is "1.0" or "3.0". This tendency is the same when the skew angle θv is changed.

The pushing force pushing the airflow to the shroud inner surface portion 343 increases with the increase of the down-flow velocity Vdf. Accordingly, it may be effective for suppressing the separation of the air around the shroud of the impeller to design the aspect ratio ARv of the tooth portion 62 to be between 1.0 and 3.0.

Accordingly, it may be desirable that the tooth portion 62 has a shape in which the aspect ratio ARv is between 1.0 and 3.0 (i.e., 1.0<ARv<3.0). In particular, it may be desirable that the tooth portion 62 has a shape in which the aspect ratio is about 2.0.

Figure 13:
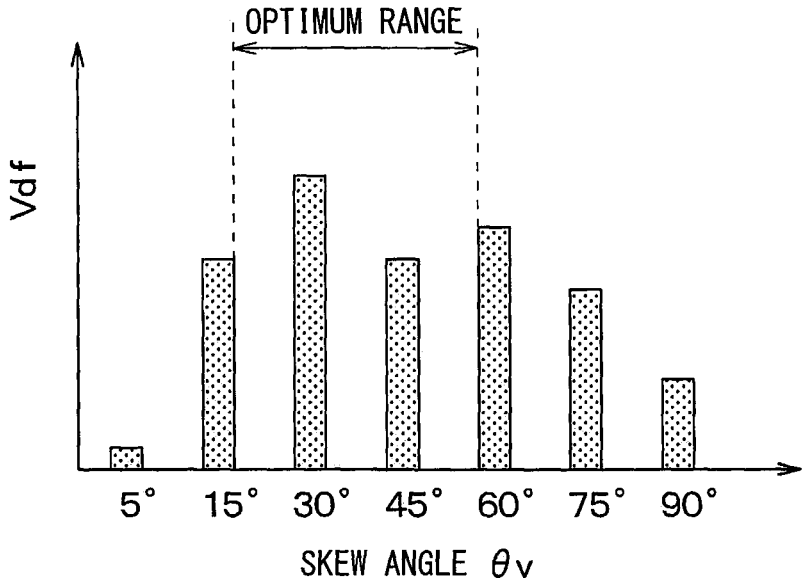
FIG. 13 is a characteristic diagram showing a change in the down-flow velocity when a skew angle of a tooth portion of the vertical vortex generating mechanism is changed.

FIG. 13 is a characteristic diagram showing a change in the down-flow velocity Vdf when the skew angle θv of the tooth portion 62 of the vertical vortex generating mechanism 60 is changed. FIG. 13 shows a result of 3D modeling of each tooth portion 62 and quantification of the down-flow velocity Vdf on the downstream side of each tooth portion 62 by CFD analysis.

As shown in FIG. 13, the down-flow velocity Vdf becomes significantly larger near the skew angle θv of "30 degrees" than when the skew angle θv is "15 degrees" or "60 degrees". This tendency is the same when the aspect ratio ARv is changed.

The pushing force pushing the airflow to the shroud inner surface portion 343 increases with the increase of the down-flow velocity Vdf. Accordingly, it may be effective for suppressing the separation of the air around the shroud of the impeller to design the skew angle θv of the tooth portion 62 to be between 15 degrees and 60 degrees.

Accordingly, it may be desirable to provide the tooth portion 62 in the bell mouth inner surface portion 563 such that the skew angle θv is between 15 degrees and 60 degrees (i.e., 15 degrees<θv<60 degrees). In particular, it may be desirable that the tooth portion 62 is provided on the bell mouth inner surface portion 563 such that the skew angle θv is about 30 degrees.

(Modifications)

Figure 14:
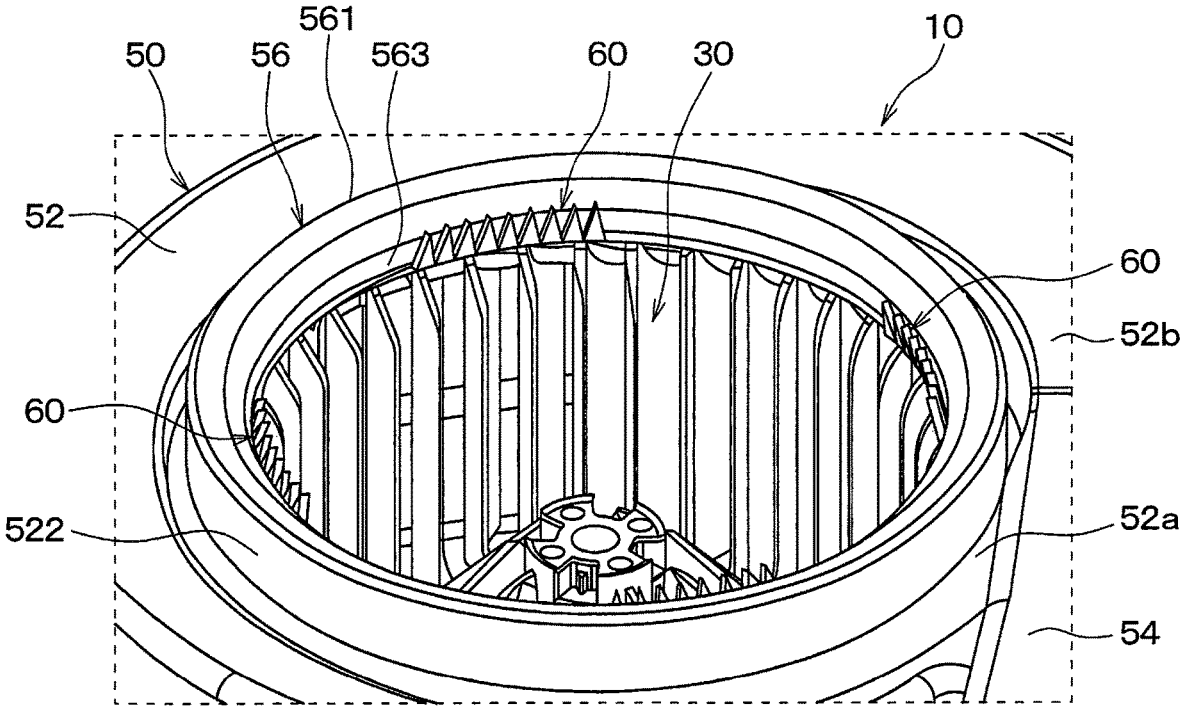
FIG. 14 is a perspective view illustrating a vicinity of an air intake portion of a centrifugal blower according to a modification example of the embodiment.

In the above-described embodiment, an example in which the tooth portions 62 constituting the vertical vortex generating mechanism 60 is arranged on entire circumference of the bell mouth inner surface portion 563 is described. However, the distribution of the tooth portions 62 is not limited to this. For example, in the centrifugal blower 10, the tooth portions 62 of the vertical vortex generating mechanism 60 may be provided in a part of the bell mouth inner surface portion 563 as shown in FIG. 14, for example.

In a part of the scroll portion 52 at which the scroll start portion 52*a* and the scroll end portion 52*b* communicate with each other, the air flowing in the scroll end portion 52*b* and the air flowing in the scroll start portion 52*a* join with each other, and accordingly the airflow may be easily disturbed. Accordingly, the vertical vortex generating mechanism 60 is provided in at least the part of the scroll portion 52 at which the scroll start portion 52*a* and the scroll end portion 52*b* communicate with each other.

Other Embodiments

The present disclosure is not limited to the typical embodiments of the present disclosure described herein, but may include various modifications, such as following configurations.

As described in the above embodiment, the aspect ratio ARv of the tooth portion 62 may be desirable to be between 1.0 and 3.0. However, the aspect ratio is not limited to this. Some of the tooth portions 62 may have the aspect ratio ARv at or below 1.0, or the aspect ratio at or above 3.0.

As described in the above embodiment, it may be desirable to provide the tooth portion 62 on the bell mouth inner surface portion 563 such that the skew angle θv is between 15 degrees and 60 degrees. However, the skew angle θv is not limited to this. Some tooth portions 62 may be provided on the bell mouth inner surface portion 563 to have the skew angle θv at or below 15 degrees, or the skew angle θv at or above 60 degrees.

As described in the above embodiment, it may be desirable that the thickness Tv of the tooth portion 62 is at or below the thickness Ts of the shroud 34. However, the thickness Tv of the tooth portion 62 is not limited to this. The thickness Tv of the tooth portion 62 may be a lower limit within a range in which the strength of the tooth portion 62 can be secured, for example.

As described in above embodiment, it may be desirable that the air intake portion 56 and the vertical vortex generating mechanism 60 are provided as a single component. However, the air intake portion 56 and the vertical vortex generating mechanism 60 may be provided separately and adhered by adhesive, for example.

In the above-described embodiment, the vertical vortex generating mechanism 60 is constituted by tooth portions 62 having a triangle shape. However, the configuration of the vertical vortex generating mechanism 60 is not limited to this. The vertical vortex generating mechanism 60 may be constituted by multiple protrusions having a triangular cone shape, for example, as long as the protrusion generates vertical vortex.

In the above-described embodiment, the centrifugal blower 10 of the present embodiment is used in the blower unit of a vehicular air-conditioning device. However, the centrifugal blower 10 of the present disclosure may be widely used in other devices such as a stationary air-conditioning device, for example.

In the above-described embodiment, the impeller 30 is a sirocco fan in which the blades 32 faces a leading side. However, the impeller 30 is not limited to this. The impeller 30 may be a turbofan in which the blades 32 face a trailing side, for example.

In the above-described embodiment, the casing 50 has the scroll portion 52. However, the casing 50 is not limited to this. For example, the casing 50 may be an all-round blow-out type casing 50 that does not have the scroll portion 52.

Needless to say, in the embodiments described above, the elements constituting the embodiment are not necessarily essential unless clearly expressed as particularly essential, or considered as obviously essential in principle, for example.

In the embodiments described above, values such as numbers of the constituent elements, numerical values, quantities, and ranges in the embodiment are not limited to the specific values described herein unless clearly expressed as particularly essential, or considered as obviously limited to the specific values in principle, for example.

In the embodiments described above, the shapes, positional relationships, or other conditions of the constituent elements and the like described in the embodiment are not limited to specific shapes, positional relationships, or other conditions unless clearly expressed, or limited to the specific shapes, positional relationships, or other conditions in principle.

CONCLUSION

According to a first aspect shown in a part or all of the above-described embodiment, the centrifugal blower has a shape in which substantially no step is formed between the bell mouth inner surface portion and the shroud inner surface portion. In addition, the vertical vortex generating mechanism configured to generate a vertical vortex is provided on the bell mouth inner surface portion.

According to a second aspect, in the centrifugal blower, the vertical vortex generating mechanism has the tooth portions having a triangle shape. The tooth portion is provided on the bell mouth inner surface portion and tilted. The tip portion at which the two sides intersect each other is located upstream of the base portion in contact with the bell mouth inner surface portion. The tip portion is located on the inner side of the base portion in the radial direction.

Accordingly, the vertical vortex can be generated at the two sides of the tooth portion when the air flowing along the bell mouth inner surface portion passes the tooth portion. By this vertical vortex, the kinetic energy of the airflow away from the bell mouth inner surface portion is added to the airflow close to the bell mouth inner surface portion, and the air flowing from the bell mouth inner surface portion toward the shroud inner surface portion is pushed to the shroud inner surface portion.

According to a third aspect, in the centrifugal blower, the tooth portion has the aspect ratio between 1.0 and 3.0. This is based on the results of the airflow analysis by simulation conducted by the inventors which indicates the aspect ratio of the tooth portion between 1.0 and 3.0 is effective for suppressing the separation on the shroud side of the impeller. The width is the length between the two sides of the tooth portion at a position where the length between the two sides is the largest. The height is the length from the tip portion to a part of the base portion at which the length from the tip portion is the smallest in the base portion. The aspect ratio is the ratio of the height to the width.

According to a fourth aspect, in the centrifugal blower, the tooth portion is provided on the bell mouth inner surface portion such that the skew angle is between 15 degrees and 60 degrees. This is based on the results of the airflow analysis by simulation conducted by the inventors which indicates the skew angle of the tooth portion between 15 degrees and 60 degrees is effective for suppressing the separation around the shroud. The skew angle is an angle between a direction extending from the base portion to the tip portion of the tooth portion and a direction in which the bell mouth inner surface portion extends.

According to a fifth aspect, in the centrifugal blower, the thickness of the tooth portion is equal to or smaller than the thickness of the shroud. Since the thickness of the tooth portion is small, the vertical vortex is appropriately generated by the two sides of each of the tooth portions.

According to a sixth aspect, in the centrifugal blower, the vertical vortex generating mechanism and the air intake portion are provided as a single component. The tooth portion is provided at a part of the bell mouth inner surface portion whose diameter is the smallest in the bell mouth inner surface portion.

According to this, since the tip portion of the tooth portion does not overlap the bell mouth inner surface portion in the axial direction of the rotation shaft, the vertical vortex generating mechanism and the air intake portion can be formed as a single component by a molding process in which a die cutting direction is along the axial direction of the rotation shaft without an undercut processing. As a result, an increase in manufacturing cost of the centrifugal blower due to the addition of the vertical vortex generating mechanism can be suppressed.

According to the seventh aspect, the air intake portion and the shroud of the centrifugal blower are designed such that the smallest diameter in the bell mouth inner surface portion is equal to or smaller than the smallest diameter in the shroud inner surface portion. Accordingly, the turbulence caused by a collision of the air flowing along the bell mouth inner surface portion with the shroud can be suppressed.

What is claimed is:

1. A centrifugal blower comprising:

a rotation shaft;

an impeller that has a plurality of blades arranged radially about an axis line of the rotation shaft, and a shroud having an annular shape and connecting end parts of the plurality of blades in an axial direction of the rotation shaft, the impeller being configured to rotate about the axis line of the rotation shaft to draw an air therein in the axial direction and discharge the air outward in a radial direction of the rotation shaft; and a casing that accommodates the impeller and includes an air intake portion positioned adjacent to the shroud, the air intake portion having a bell mouth shape to guide the drawn air to an inside of the impeller, wherein the air intake portion has a bell mouth lower end portion that includes a downstream end of the air intake portion with respect to an airflow, and a bell mouth inner surface portion that includes a radially inner surface of the air intake portion, the shroud has a shroud upper end portion that includes an upstream end of the shroud with respect to the airflow, and a shroud inner surface portion that includes a radially inner surface of the shroud, the bell mouth lower end portion and the shroud upper end portion face each other in the axial direction across a gap, a difference between a diameter smallest in the bell mouth inner surface portion and a diameter smallest in the shroud inner surface portion is equal to or smaller than a thickness of the shroud, and a vertical vortex generating mechanism configured to generate a vertical vortex whose rotation center axis is along a main flow of the air is provided on the bell mouth inner surface portion.

2. The centrifugal blower according to claim 1, wherein the vertical vortex generating mechanism includes a plurality of tooth portions each of which has a triangle shape, each tooth portion of the plurality of tooth portions is provided on the bell mouth inner surface portion, the each tooth portion includes a tip portion at which two sides of the each tooth portion intersect each other, and a base portion that is in contact with the bell mouth inner surface portion, and the each tooth portion is tilted such that the tip portion is located upstream of the base portion with respect to the airflow, the tip portion being located inside the base portion in the radial direction.

3. The centrifugal blower according to claim 2, wherein a width is a largest distance between the two sides of the each tooth portion, a height is a smallest length from the base portion to the tip portion, an aspect ratio is a ratio of the height to the width, and the aspect ratio of the each tooth portion is larger than 1.0 and smaller than 3.0.

4. The centrifugal blower according to claim 2, wherein a skew angle is an angle between a direction extending from the base portion to the tip portion and a direction in which the bell mouth inner surface portion extends, and the each tooth portion is provided on the bell mouth inner surface portion such that the skew angle is larger than 15 degrees and smaller than 60 degrees.

5. The centrifugal blower according to claim 2, wherein a thickness of the each tooth portion is equal to or smaller than the thickness of the shroud.

6. The centrifugal blower according to claim 2, wherein the vertical vortex generating mechanism and the air intake portion are provided as a single component, and the each tooth portion is provided on a part of the bell mouth inner surface portion having the smallest diameter in the bell mouth inner surface portion.

7. The centrifugal blower according to claim 1, wherein the diameter smallest in the bell mouth inner surface portion is equal to or smaller than the diameter smallest in the shroud inner surface portion.

* * * * *